US009161873B2

(12) United States Patent
Tindall

(10) Patent No.: US 9,161,873 B2
(45) Date of Patent: Oct. 20, 2015

(54) SYSTEM AND METHOD FOR EXTRICATING A VICTIM

(71) Applicant: Jary Edward Tindall, Hattiesburg, MS (US)

(72) Inventor: Jary Edward Tindall, Hattiesburg, MS (US)

( * ) Notice: Subject to any disclaimer, the term of this patent is extended or adjusted under 35 U.S.C. 154(b) by 56 days.

(21) Appl. No.: 13/922,431

(22) Filed: Jun. 20, 2013

(65) Prior Publication Data

US 2013/0343862 A1 Dec. 26, 2013

Related U.S. Application Data

(60) Provisional application No. 61/661,872, filed on Jun. 20, 2012, provisional application No. 61/692,013, filed on Aug. 22, 2012, provisional application No. 61/716,053, filed on Oct. 19, 2012.

(51) Int. Cl.
*A61G 7/10* (2006.01)
*A61G 3/06* (2006.01)

(52) U.S. Cl.
CPC ..... *A61G 7/1046* (2013.01); *A61G 3/062* (2013.01); *A61G 7/1051* (2013.01)

(58) Field of Classification Search
CPC .... A61G 7/1046; A61G 7/1051; A61G 3/062
USPC ..... 414/809, 921; 5/89.1, 83.1, 85.1, 87.1; 212/326, 327, 324; 254/279, 323–325, 254/329, 338
See application file for complete search history.

(56) References Cited

U.S. PATENT DOCUMENTS

| | | | | | |
|---|---|---|---|---|---|
| 2,650,725 | A | * | 9/1953 | Hoyer et al. | 414/549 |
| 2,793,768 | A | * | 5/1957 | Schaedler | 414/541 |
| 2,846,091 | A | * | 8/1958 | Heffner | 414/550 |
| 3,656,637 | A | * | 4/1972 | Lynn et al. | 414/542 |
| 3,677,424 | A | * | 7/1972 | Anderson | 414/550 |
| 3,701,170 | A | | 10/1972 | Bond | |
| 3,829,914 | A | | 8/1974 | Treat | |
| 3,983,584 | A | * | 10/1976 | Holecek | 5/87.1 |
| 4,054,267 | A | | 10/1977 | Berg et al. | |
| 4,243,147 | A | | 1/1981 | Twitchell et al. | |
| 4,296,509 | A | * | 10/1981 | Simmons et al. | 5/85.1 |
| 4,544,321 | A | * | 10/1985 | Lanier | 414/542 |
| 4,627,119 | A | | 12/1986 | Hachey et al. | |
| 4,806,060 | A | * | 2/1989 | Molski | 414/462 |
| 4,809,372 | A | * | 3/1989 | Dickens | 5/83.1 |
| 4,944,056 | A | | 7/1990 | Schroeder et al. | |
| 5,016,300 | A | * | 5/1991 | Jandrakovic | 5/85.1 |
| 5,072,840 | A | * | 12/1991 | Asakawa et al. | 212/312 |
| 5,077,844 | A | * | 1/1992 | Twitchell et al. | 5/87.1 |
| 5,235,711 | A | * | 8/1993 | Jandrakovic | 5/87.1 |
| 5,337,908 | A | | 8/1994 | Beck, Jr. | |
| 5,388,289 | A | * | 2/1995 | Casperson | 5/86.1 |
| 5,499,408 | A | | 3/1996 | Nix | |
| 5,539,941 | A | | 7/1996 | Fuller | |
| 5,694,654 | A | | 12/1997 | Roy | |
| 6,006,377 | A | | 12/1999 | Asakawa | |
| 6,174,010 | B1 | * | 1/2001 | Fanger et al. | 294/81.4 |

(Continued)

FOREIGN PATENT DOCUMENTS

GB 191300459 A 6/1913

*Primary Examiner* — Kaitlin Joerger
(74) *Attorney, Agent, or Firm* — King & Schickli, PLLC

(57) ABSTRACT

A system is provided for extricating a patient from a position from which extrication is desired. The system includes a first hoist unit, a second hoist unit, a patient lifting pad and a portable lift stand.

16 Claims, 9 Drawing Sheets

(56) References Cited

U.S. PATENT DOCUMENTS

| | | | | |
|---|---|---|---|---|
| 6,273,668 | B1 * | 8/2001 | Kameda | 414/462 |
| 6,600,278 | B1 | 7/2003 | Bretzius | |
| 6,637,610 | B1 * | 10/2003 | Cheeseboro | 212/327 |
| 6,708,622 | B2 | 3/2004 | Bergeron | |
| 7,240,621 | B2 | 7/2007 | Chepurny et al. | |
| 7,278,808 | B1 | 10/2007 | Sisk, Sr. et al. | |
| 7,284,745 | B2 | 10/2007 | Keane et al. | |
| 7,618,223 | B1 * | 11/2009 | Begley | 414/139.4 |
| 7,634,825 | B2 | 12/2009 | Chepurny et al. | |
| 8,286,281 | B1 * | 10/2012 | Toothman | 5/81.1 R |
| 2005/0044629 | A1 | 3/2005 | Rouse et al. | |
| 2005/0104052 | A1 * | 5/2005 | Bilcik | 254/279 |
| 2006/0099059 | A1 * | 5/2006 | Ervin | 414/462 |
| 2010/0229299 | A1 * | 9/2010 | Lear | 5/89.1 |

* cited by examiner

SYSTEM AND METHOD FOR EXTRICATING A VICTIM

This utility application claims the benefit of priority in U.S. Provisional Patent Application Ser. No. 61/661,872 filed on Jun. 20, 2012, and U.S. Provisional Patent Application Ser. No. 61/716,053 filed on Oct. 19, 2012, the entirety of the disclosures of which are incorporated herein by reference. This utility application also claims the benefit of U.S. Provisional Patent Application Ser. No. 61/692,013 filed on Aug. 22, 2012.

TECHNICAL FIELD

This document relates to systems and the methods for extricating victims or patients from positions from which they need extricating.

BACKGROUND

Currently, emergency agencies and personnel are called upon to extricate persons from vehicles due to accidents, persons becoming incapacitated from medical reasons, obesity, physical disabilities, etc. To date, this is a completely physical event on the part of the emergency personnel. Current training offers little to no safety during the extrication. It remains a hands on physical event which requires several emergency personnel to lift, pull and tug on the injured patient. This also potentially causes more injuries and increases the risk of neck and spinal injuries to the patient. Consequently, injury rates to emergency personnel and patients continue to be high. There are no current offerings that allow the emergency personnel to safely extract a person from a vehicle without physically jeopardizing the patient or the personnel.

The present system/apparatus and method are designed to assist in vehicle extrication and lifting of a patient without the emergency personnel having to physical lift or pull the patient. By using two lift hoists in conjunction with a removable lifting pad, emergency personnel are able to remove a patient up and out of a vehicle while safely securing the patient in the removable lifting pad. The two points of movement allow the emergency personnel to move the lower body or upper body independent of each other, thus enabling a more precise movement as needed. Even if unconscious, the patient will be removed safely while secured in the removable lifting pad. Because this is a manual extraction and lifting system, weather is not an issue. The lack of electrical or battery power is no detriment.

While the system/apparatus and method are particularly useful in extricating a patient from a vehicle, it should be appreciated that they are just as useful in extricating a patient from other positions or situations from which extrication is needed. These include, but are no way limited to extrication from a confined space of any type, a bath tub or even building rubble following an earthquake, hurricane, tornado or other disaster.

SUMMARY

In accordance with the purposes as described herein, an improved system and method are provided for extracting or extricating a patient or incapacitated individual from a vehicle. This system comprises a first hoist unit, a second hoist unit, a patient lifting pad and a portable lift stand. The patient lifting pad is applied to the patient and the lift stand is erected adjacent the patient. The first and second hoist units are connected between the patient lifting pad and the lift stand and then used to lift the patient in a controlled manner from virtually any space including confined spaces such as a vehicle.

The lift stand includes a first support post, a second support post, a first strut and a second strut. The lift stand further includes first and second cross members. The first and second support posts are pivotally secured together at their proximal ends and are also connected to the first cross member. The first and second struts have first ends for engaging the floor or ground so as to form a lift stand with stable four-point ground contact. Alternatively, the struts may be positioned to engage a vehicle roof and form a lifting support over a door opening of a vehicle through which an individual may be extracted. The second ends of the struts are connected to the first cross member. Further the first and second struts are connected to the second cross member at or adjacent to the first ends. Both the struts and posts include nonskid feet for extra stability. Further, both the struts and posts are telescoping to allow for height and length adjustment as necessary. In addition two ratchet lines are provided to secure the struts in position on the roof of the vehicle and provide stability during the lifting operation.

The first hoist unit has a first housing including a first connection point, a first support connected between the first connection point and the first strut and a first line that may be extended or retracted by operation of the first hoist, the first line having a first distal end connected to the lifting pad. The second hoist has a second housing including a second connection point, a second support connected between the second connection point and the second strut and a second line that may be extended or retracted by operation of the second hoist, that second line having a second distal end connected to the patient lifting pad. A drive tool is provided for the first and second hoist. The drive tool may comprise a manual crank, a power tool, an electric drill, a battery powered electric drill, a wrench, a pneumatic powered wrench, a screw driver and an electric screwdriver or any other appropriate device for driving the hoist units.

In accordance with an additional aspect, a method for extricating a patient from a vehicle is provided. That method may be broadly described as comprising the steps of applying a patient lifting pad to a patient, connecting first and second lift lines of first and second hoist units to the lifting pad and operating the first and second hoist units to lift the patient. In one possible embodiment the method includes connecting the first and second hoist units to a portion of an emergency vehicle having a height greater than the vehicle holding the patient and then lifting the patient from the vehicle through the door opening.

In yet another embodiment the method includes positioning a lift stand adjacent a door of the vehicle holding the patient. This is followed by connecting the first and second hoist units between the lift stand and the patient lifting pad. This embodiment also includes the step of engaging a portion of the lift stand with a roof of the vehicle above the door through which the patient will be lifted from the vehicle. Further the method includes connecting the first and second hoist units between the lift stand and the patient lifting pad and then using a drive tool to operate the first and second hoist units.

BRIEF DESCRIPTION OF THE DRAWINGS

The accompanying drawings incorporated herein and forming a part of the specification, illustrate several aspects of the system and method and together with the description serve to explain certain principles thereof. In the drawings.

Reference will now be made in detail to the present preferred apparatus and method embodiments for extricating a patient from a position such as from a vehicle.

DETAILED DESCRIPTION

Figure 1:
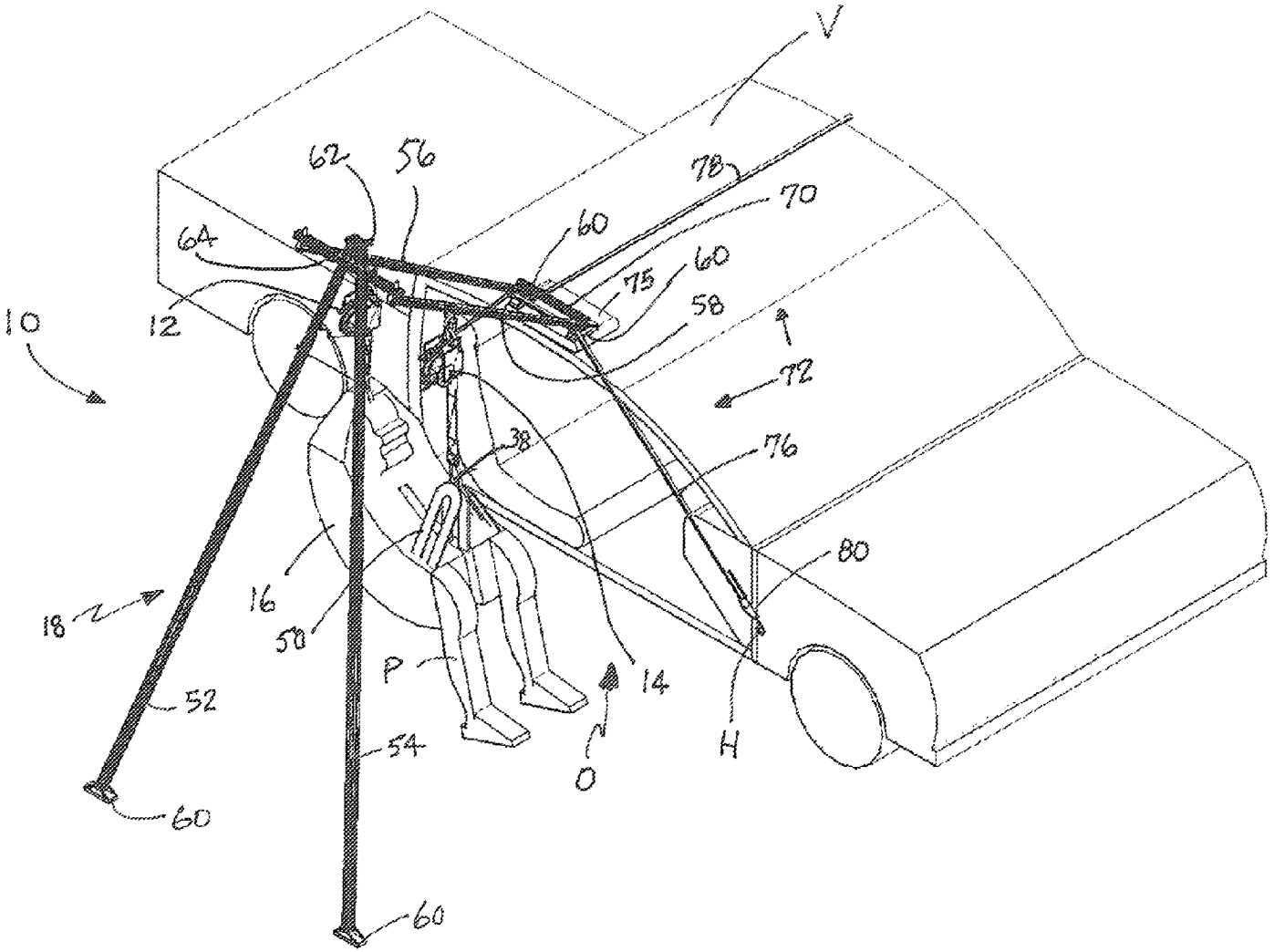
FIG. 1 is a schematical perspective view of the system or apparatus for extricating a patient from a vehicle with the patient shown cradled in the lifting pad beside the door opening through which the patient has been extricated.
Figure 2:
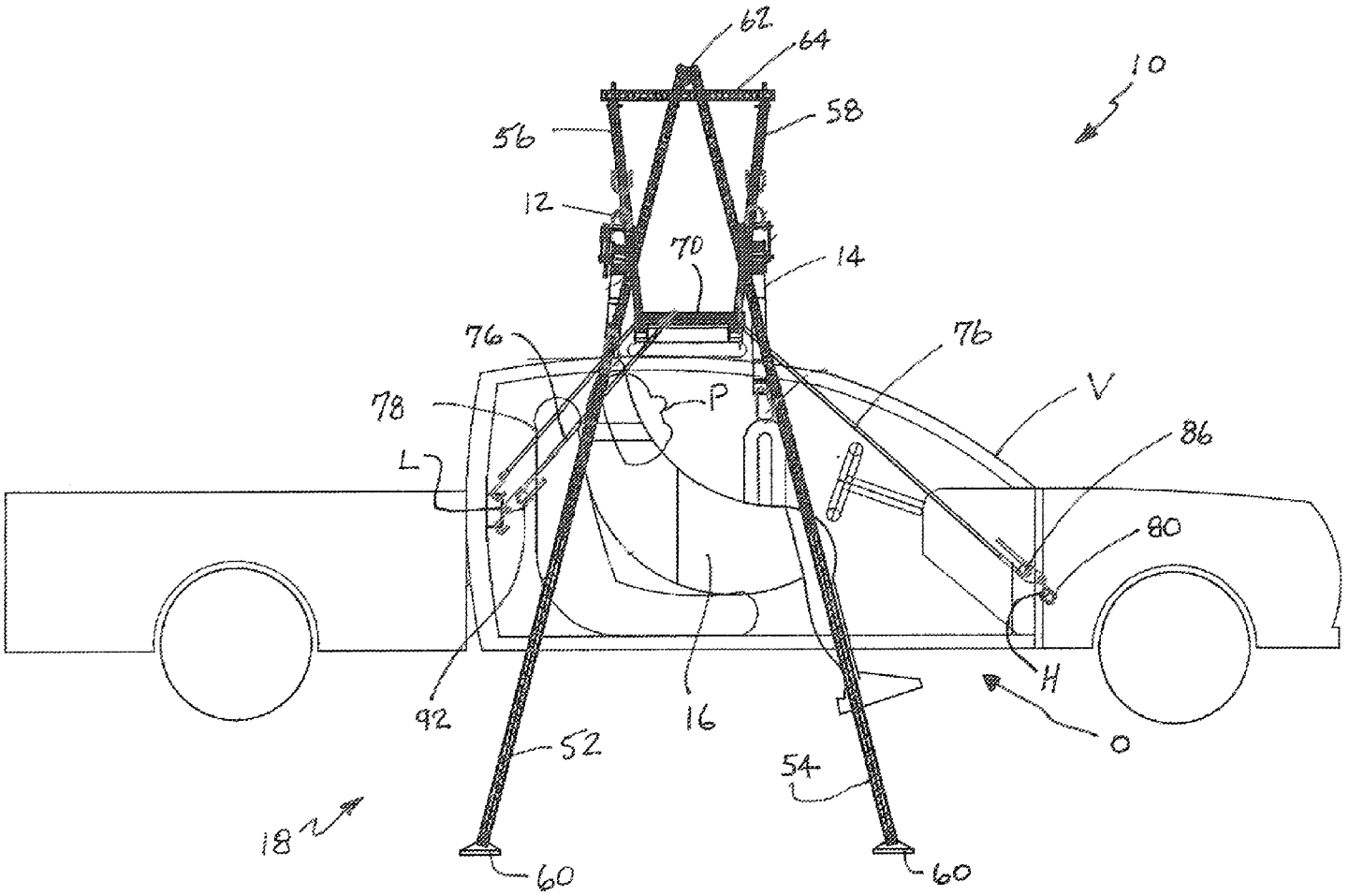
FIG. 2 is a schematical side elevational view of the system illustrated in FIG. 1 but with the patient shown seated in the vehicle.
Figure 3:
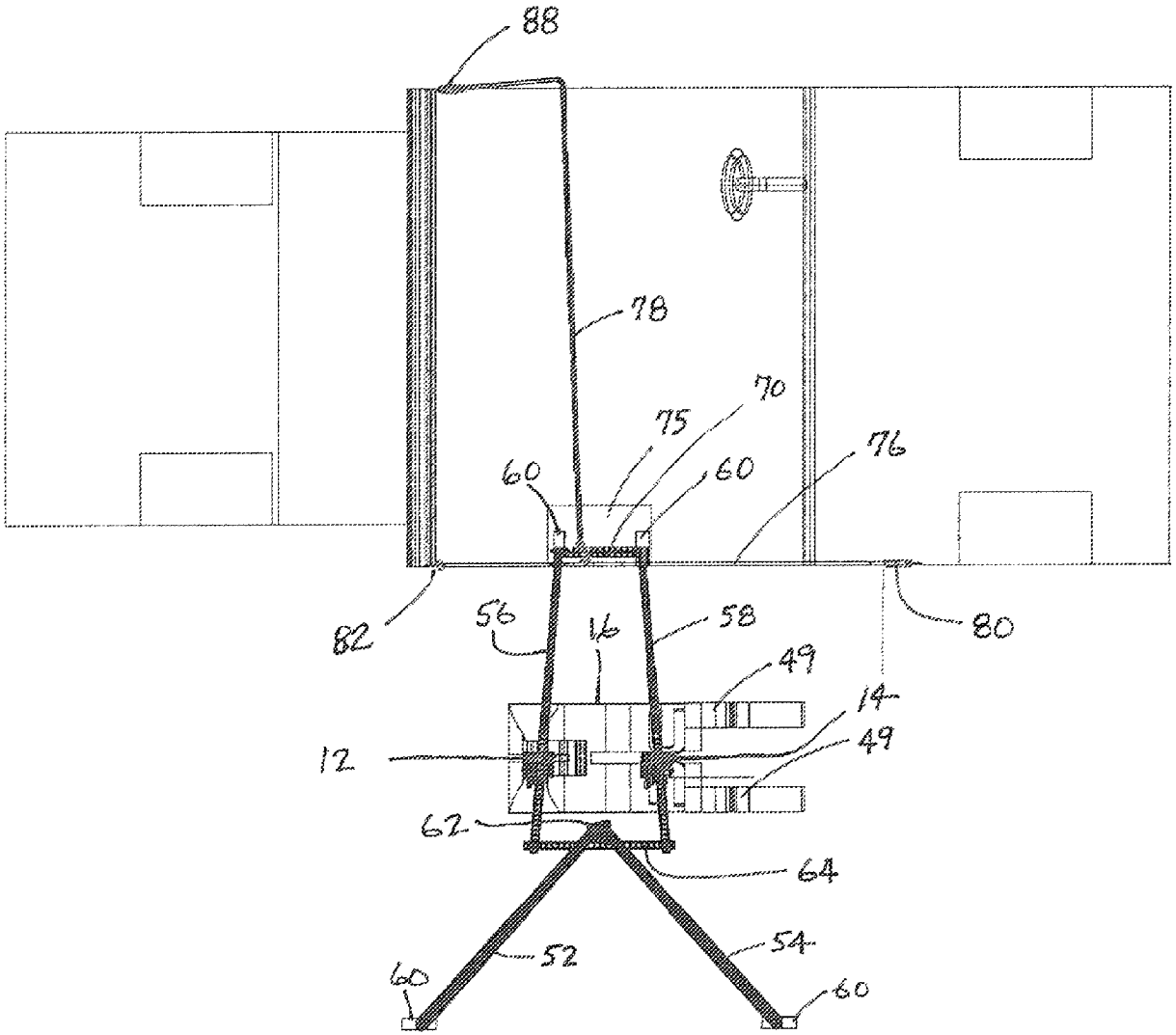
FIG. 3 is a top schematical plan view of the system or apparatus illustrated in FIG. 1 sans patient.

Reference is now made to FIGS. 1-3 illustrating the portable patient extrication system or apparatus 10 which may be used to extricate a patient from any particular position whether that be within a vehicle, in a residential or commercial building or even outside from a position on the ground. In the illustrated embodiments, the patient is shown being extricated from a vehicle V. The system 10 may be broadly described as including a first hoist unit 12, a second hoist unit 14, a patient lifting pad 16 and a portable lift stand 18.

Figure 6:
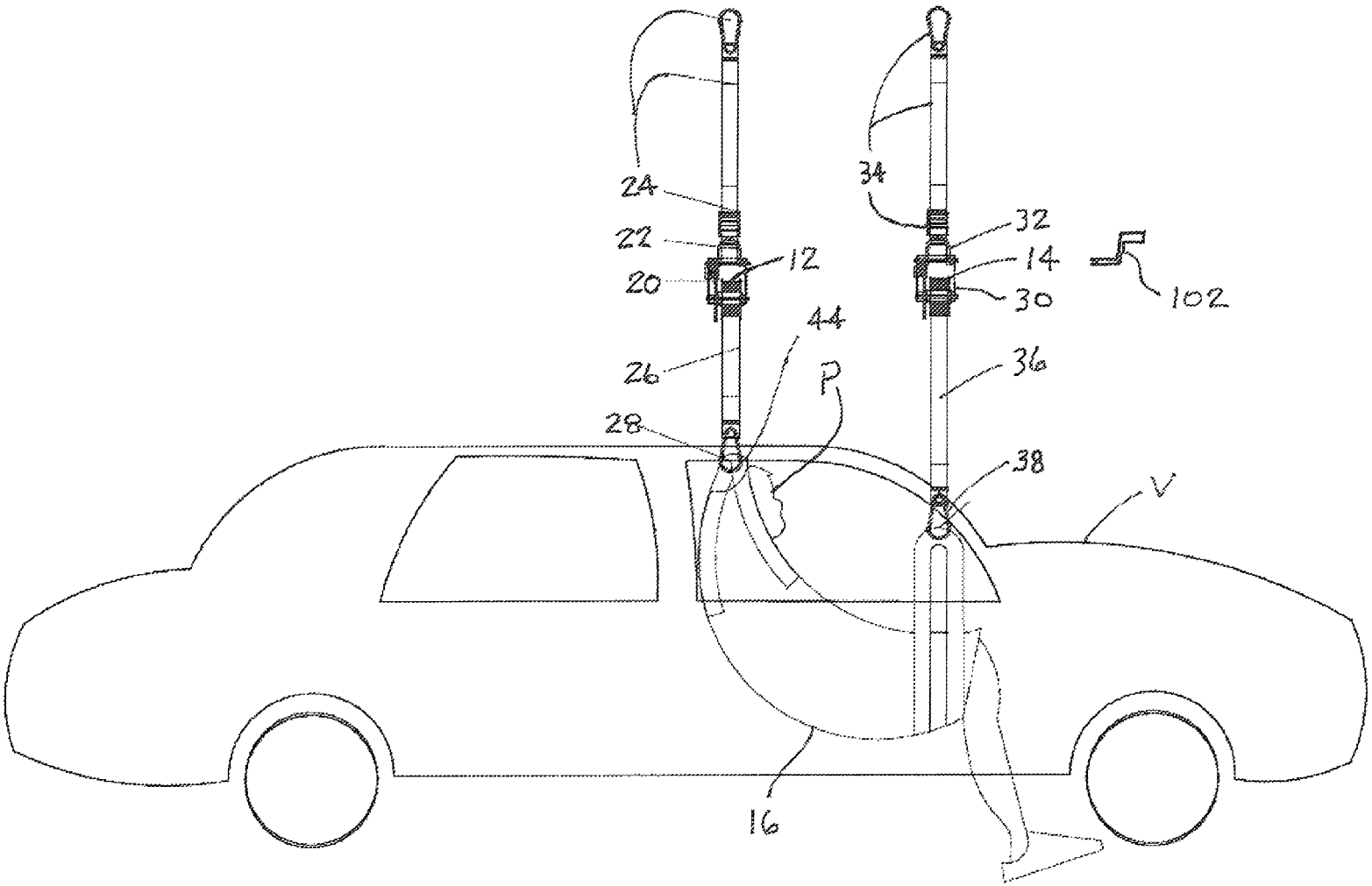
FIG. 6 is a detailed schematical side elevational view of the first and second hoist units connected to the patient lifting pad.

As best illustrated in FIG. 6, the first hoist unit 12 includes a first housing 20 having a first connection point 22. A first support (bracket, webbing and connector) 24 is provided for connecting the first hoist unit 12 to the portable lift stand 18 such as to the first strut 56. The first hoist unit 12 also includes a first line 26 that may be extended or retracted by operation of the first hoist unit 12. First line 26 has a first distal end connector 28 that is connected to the patient lifting pad 16.

The second hoist unit 14 includes a second housing 30 having a second connection point 32. A second support (bracket, webbing and connector) 34 is connected between the second connection point 32 and the portable lift stand 18 such as to the second strut 58. The second hoist unit 14 also includes a second lift line 36 that may be extended or retracted by operation of the second hoist unit 14. The second lift line 36 has a second distal end connector 38 that is connected to the patient lifting pad 16.

Figure 5:
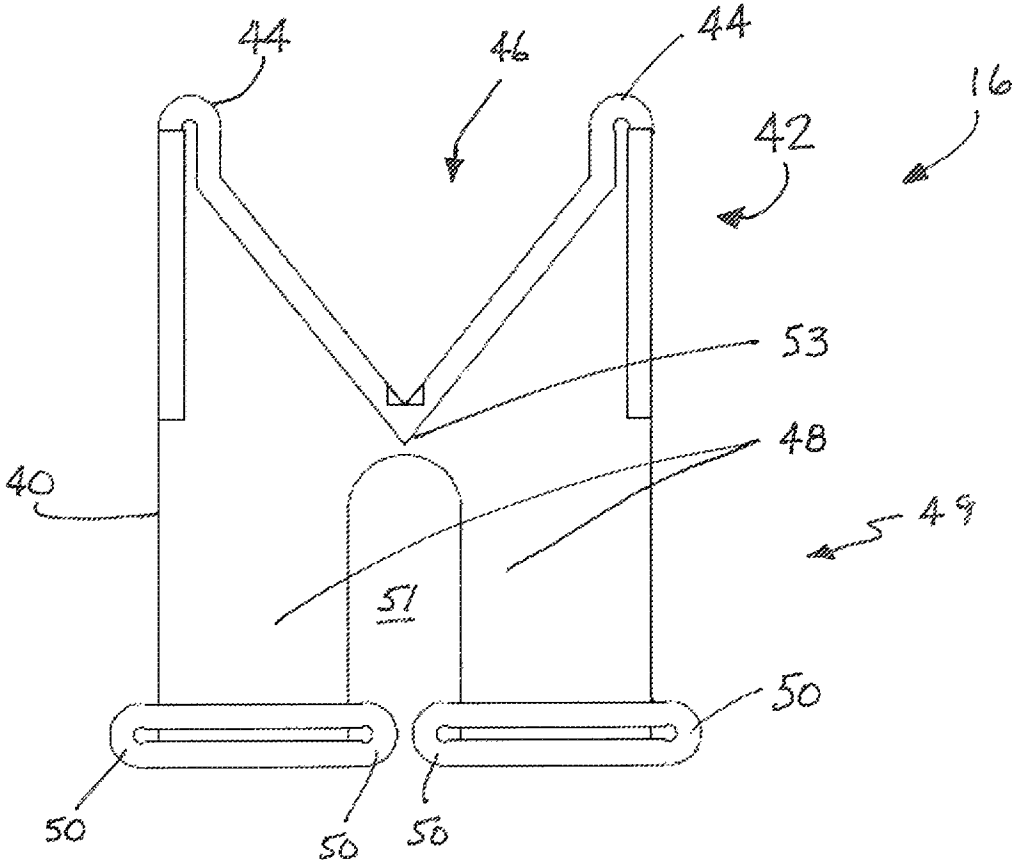
FIG. 5 is a detailed schematical top plan view of the removable patient lifting pad.

As best illustrated in FIG. 5, the patient lifting pad 16 comprises a body 40 made of Cordura 1050 or equivalent ballistic style nylon or other appropriate material having a split back section 42 including two lifting loops 44 and a V-shaped cutout 46 and a split leg section 48 wherein each leg supporting portion 49 includes two opposed lifting loops 50. As should be appreciated, the patient lifting pad 16 includes a relatively narrow neck of material 53 between the V-shaped cutout 46 of the back section 42 and the cutout 51 of the split leg section 48 which makes it easier to position under the patient without having to physically lift the patient. When used to lift a patient, the split back section 42 provides excellent support of the torso of the patient while the leg loops 50 of each leg supporting portion 49 capture and support the legs to securely hold a patient in place in the pad 16 while the patient is maneuvered from the vehicle V.

As best illustrated in FIGS. 1 and 2, the portable lift stand 18 includes a first telescoping support post 52, a second telescoping support post 54, a first telescoping strut 56 and a second telescoping strut 58. The telescoping feature allows the length of each post 52, 54 and each strut 56, 58 to be adjusted as necessary for any particular lifting application. This includes the lifting of a patient P from a vehicle V as illustrated in the current drawing FIGS. 1-3 or from any other position. A non-skid foot 60 is provided on the distal end of each post 52, 54 and each strut 56, 58.

As should be appreciated, a pivot pin 62 connects the two posts 52, 54 at the proximal ends thereof. Further, a first cross member 64 is connected to the two posts 52, 54 by means of appropriate fasteners. The proximal ends of the struts 56, 58 are also secured by fasteners to the first cross member 64.

In the embodiment illustrated in FIGS. 1-3, the feet 60 on the first ends of the struts 56, 58 are positioned to engage the roof R of the vehicle V. A second cross member 70 is secured to the ends of the struts 56, 58 or the feet 60 on the struts by any appropriate fastener. This stabilizes the struts 56, 58 so as to maintain a particular spacing therebetween.

Figure 4:
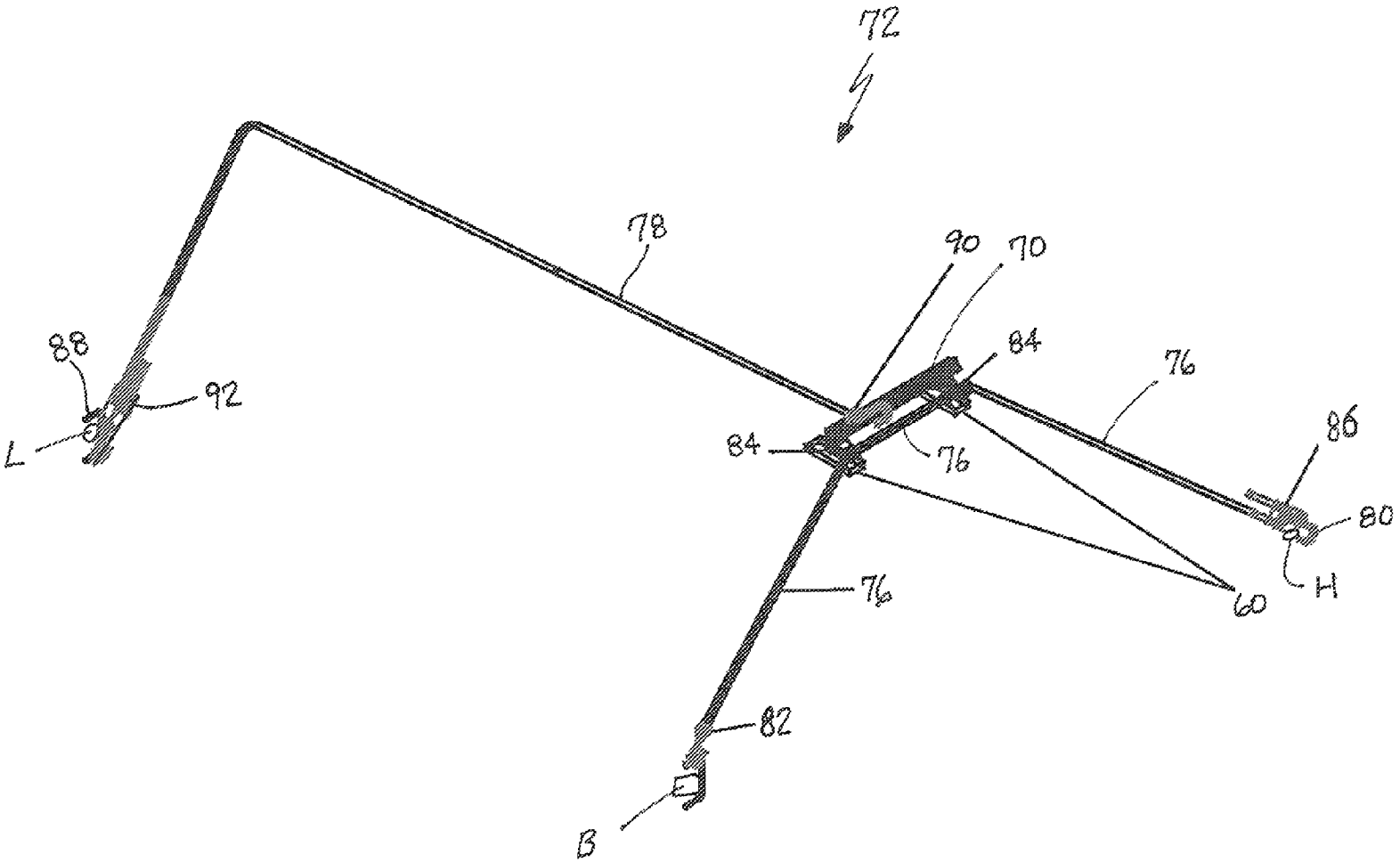
FIG. 4 is a schematical detailed perspective view showing two ratchet ropes for securing the struts of the lift stand to the roof of a vehicle.
Figure 4A:
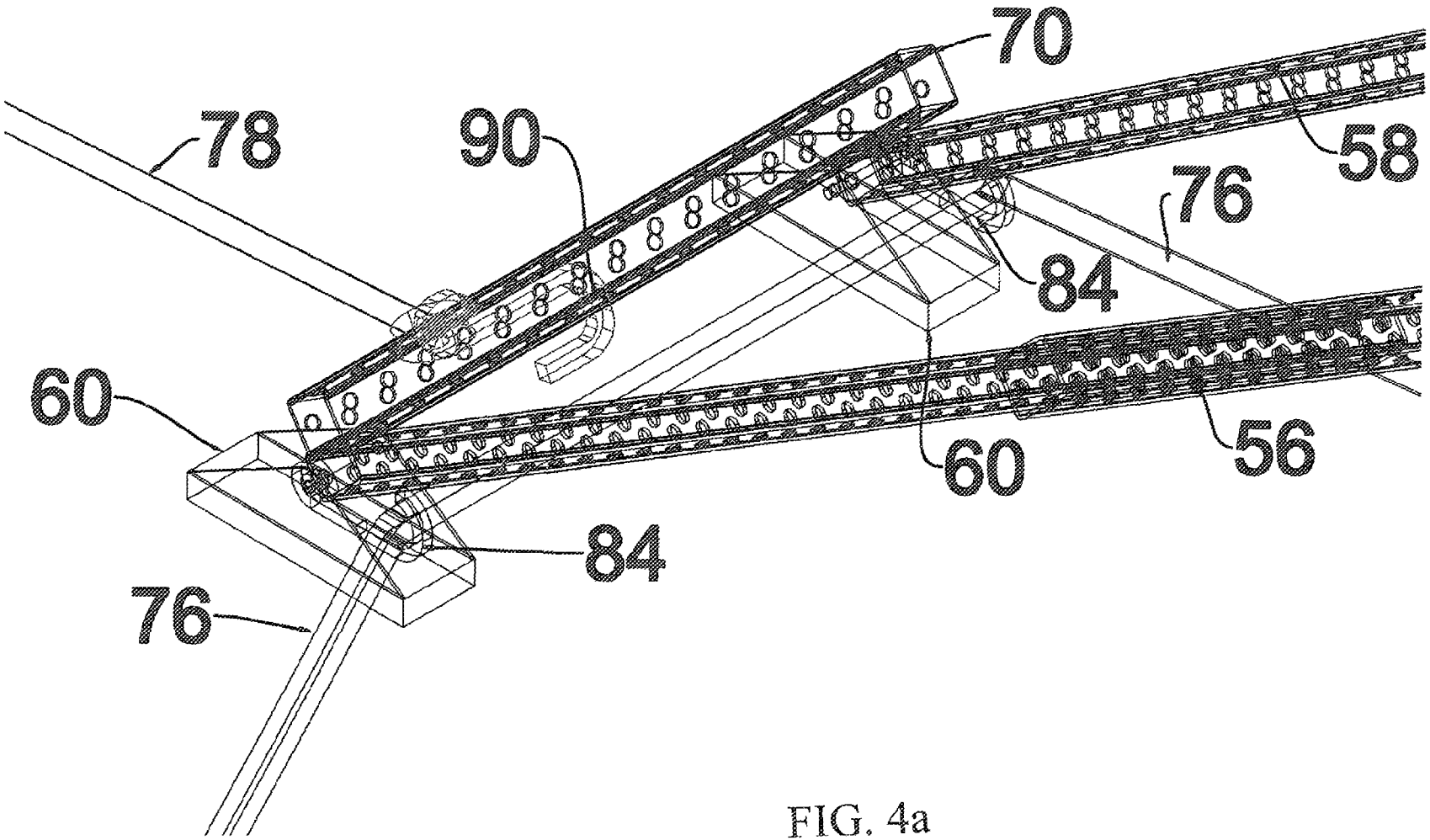
FIG. 4*a* is a detailed illustration showing the ratchet line received through hooks connected to the feet on the ends of the struts.

A fastening system, generally designated by reference numeral 72, is provided to secure the struts 56, 58 in position on the vehicle roof R. As illustrated in FIGS. 3 and 4, the fastening system 72 comprises two separate ratchet lines or ropes 76, 78. As illustrated in FIG. 4, the first ratchet rope 76 has a first connector 80 at a first end that may be secured to the hinge H of the vehicle door D and a second connector 82 at a second end that may be secured to the B pillar B of the vehicle V. As should be appreciated, an intermediate portion of the rope 76 is engaged in S shaped hooks 84 connected to the feet 60 at the first or distal end of each strut 56, 58 (see also FIG. 4*a*). A ratchet assembly 86 may be used to tighten the ratchet rope 76 and provide tension from the door hinge 8 across the feet 60 to the B pillar B to secure the struts 56, 58 in position and prevent slipping (note optional non-skid paint protecting mat or pad 75 may or may not be used). Advantageously, it should be appreciated that the ratchet rope 76 extends around the door opening O. Since the rope 76 does not occlude the opening O in any significant way whatsoever, the entire expanse of the opening may be used to extract the patient from the vehicle V.

As illustrated in FIG. 4, the second ratchet line or rope 78 includes a first connector 88 that may be secured to the door latch L of the opposite door of the vehicle V and a second connector 90 that may be secured to the second cross member 70 or over the cross member 70 and to the door latch L on the patient side of the vehicle V. As should be appreciated the ratchet rope 78 extends between the two connection points across the roof of the vehicle. The second ratchet rope 78 is connected to a second ratchet assembly 92 that may be used to tension the rope and further secure the struts 56, 58 in the desired position on the roof R of the vehicle.

Significantly, the first ratchet line or rope 76 extends across the top of the door opening generally parallel to the longitudinal axis of the vehicle. In contrast, the second ratchet line or rope 78 extends transversely across the top of the vehicle V between opposing doors. Thus, the two ratchet ropes 76, 78 generally extend perpendicular to one another and when tightened, provide a tensioning force in these two directions that functions to securely hold the struts 56, 58 in place on the roof R overlying the door opening through which the patient P will be extricated from the vehicle V. Thus, the struts 56, 58 provide a secure and stable overhead support upon which the patient may be lifted from the seat of the vehicle and maneuvered out of the door opening O on the pad 16.

A method of extricating a patient P from the vehicle V utilizing the system 10 will now be described. This method includes the step of applying a patient lifting pad 16 to a patient P within the vehicle V. More specifically, the pad 16 is positioned under the patient P by careful manipulation of the patient and the pad. Advantageously, the split back section 42 and split leg section 48 of the pad 16 define a narrow neck or intersection of material 53 that greatly aids in this process which allows the pad 16 to slide behind the back of the patient and under the legs of the patient. Once properly positioned, the first and second lift lines 26, 36 of the first and second hoist units 12, 14 are connected to the lifting pad 16. More specifically, the line 26 is connected by means of a carabiner or other connector 28 to the lifting loops 44 while the connector or carabiner 38 is connected to the lifting loops 50 of the two leg supporting portions 49. Once fully connected, the first and second hoist units 12, 14 are operated to lift the patient P from the vehicle V. More specifically, the first and second hoist units 12, 14 are manually operated by means of a drive tool 102 which, may, for example, be selected from a group of tools consisting of a manual crank, a power tool, an electric drill, a battery powered electric drill, a wrench, a pneumatic powered wrench, a screw driver and an electric screwdriver.

More specifically describing the method with reference to the application illustrated in FIGS. 1-3, it should be appreciated that the method further includes positioning or erecting the lift stand 18 adjacent a door D of the vehicle V holding the patient P. In addition the method includes connecting the first and second hoist units 12, 14 between the lift stand 18 and the patient lifting pad 16. This is done by connecting the supports 24, 34 between the connection points 22, 32 on the housings 20, 30 and the respective overlying struts 56, 58. Further, it should be appreciated that a portion of the lift stand 18, more particularly, the feet 60 of the struts 56, 58 engage with the roof R of the vehicle V above the door D through which the patient P will be lifted from the vehicle.

Figure 7A:
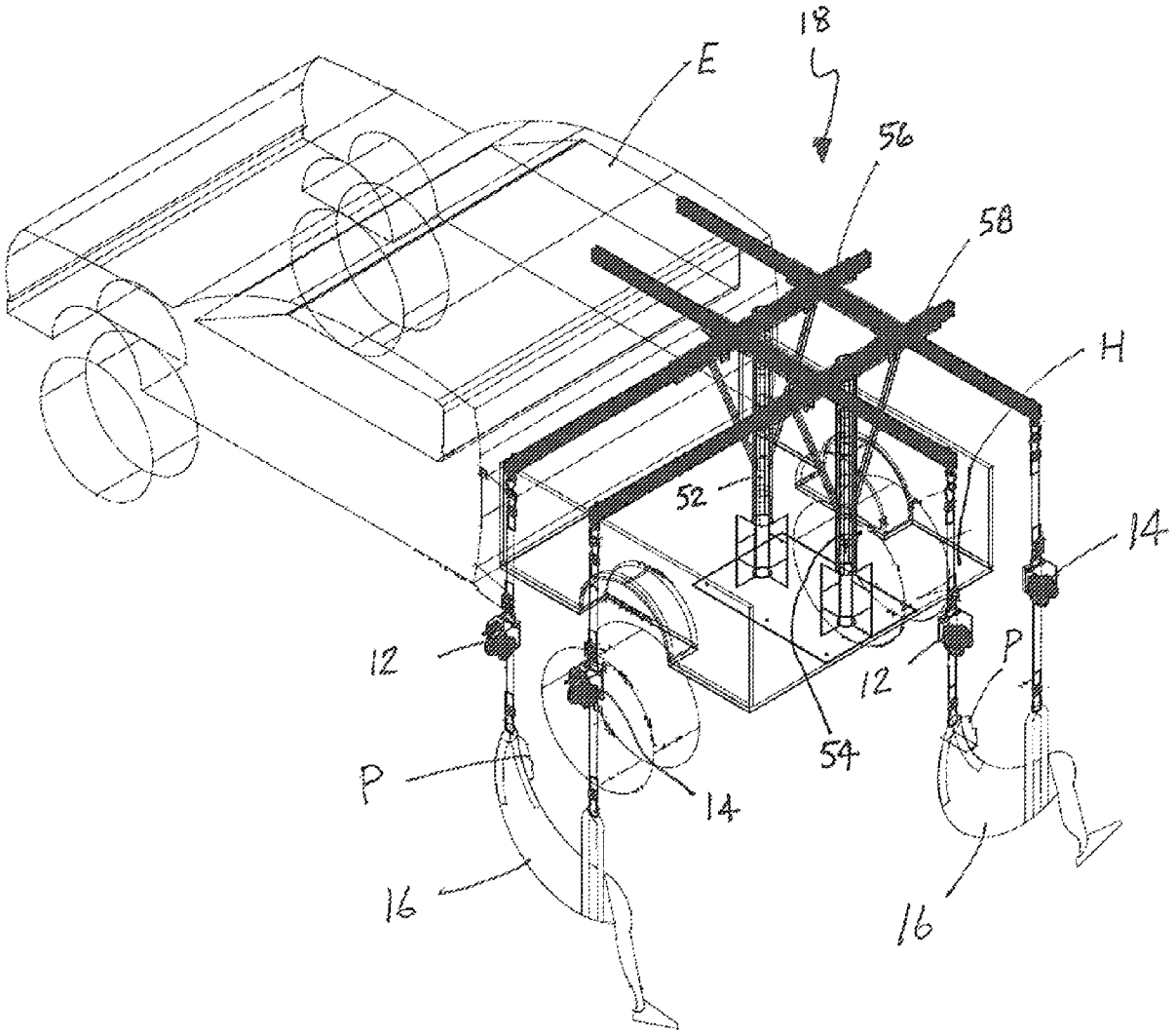
FIGS. 7*a* and 7*b* are multiple views of yet another embodiment wherein the lift stand is mounted in the bed of an emergency vehicle so that the hoist units may be positioned adjacent the opening of the vehicle through which the patient will be extricated.
Figure 7B:
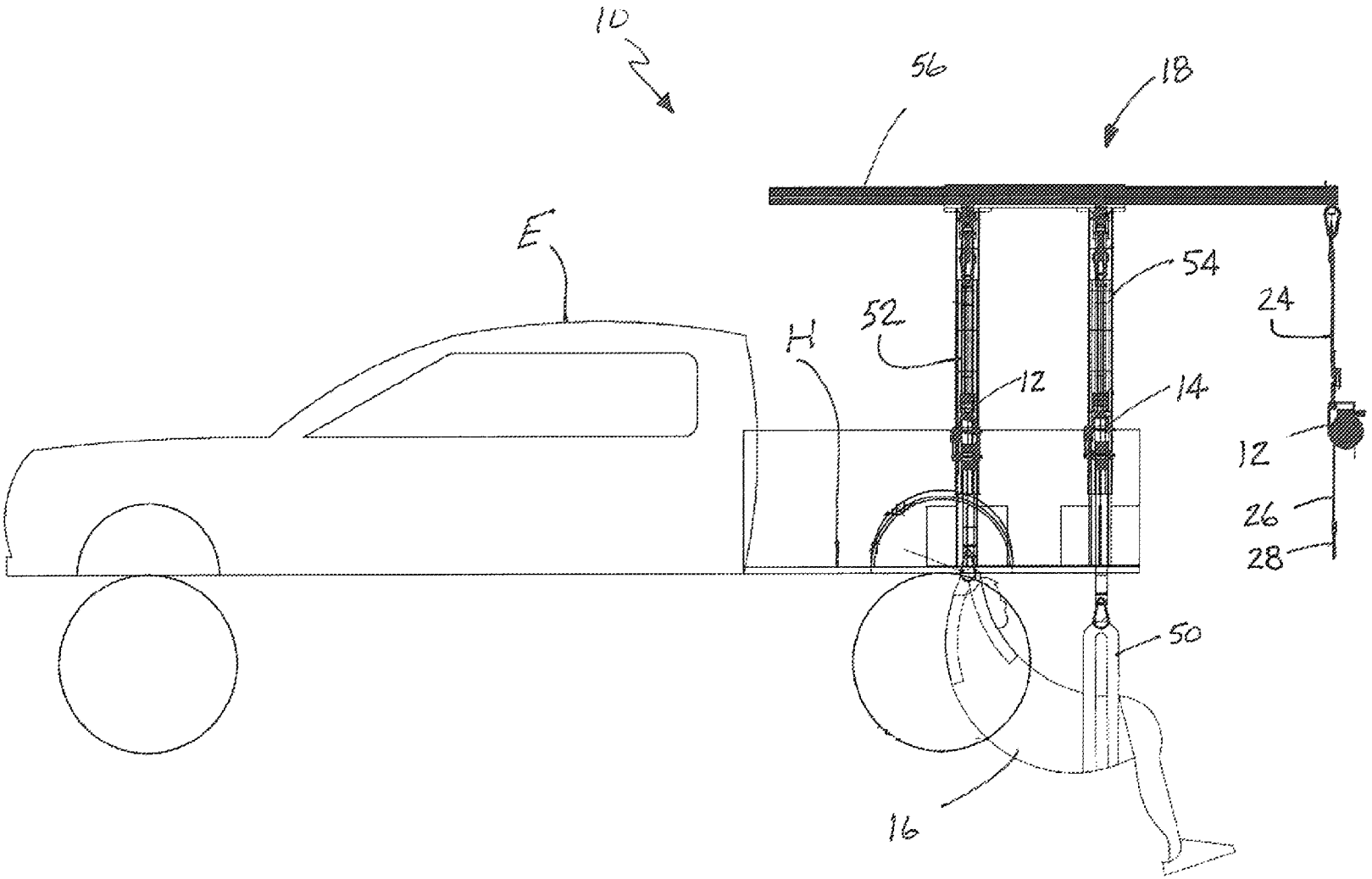

In yet another embodiment of the method illustrated in FIGS. 7*a* and 7*b*, the lift stand 18 is secured in the bed H of the emergency vehicle E. As illustrated in the double image, the struts 56, 58 on the posts 52, 54 may be oriented over a side or the end of the bed H to position the hoist units 12, 14 for connection to the pad 16 and lifting a patient P from a vehicle or other location.

The foregoing has been presented for purposes of illustration and description. It is not intended to be exhaustive or to limit the embodiments to the precise form disclosed. Obvious modifications and variations are possible in light of the above teachings. In the illustrated embodiments a patient P is extricated from a vehicle V. It should be appreciated, however, that the apparatus 10 may be utilized to extricate the patient from any position from which extrication is desired whether that position is within a vehicle, in a building or outdoors. For example, the apparatus 10 may be utilized to extricate an individual from a bathtub or other confined space. To achieve this end the telescoping struts 56, 58 are further extended to be substantially equal in length to the posts 52, 54. The four feet 60 of the posts and struts 52, 54, 56, 58 are then positioned at spaced points on the floor or ground to provide a stable base to which the hoist units 12, 14 are anchored. The patient lifting pad 16 is then applied to the patient or positioned under the patient. The hoist units 12, 14 are then connected to the lift pad 16 and then operated to lift and extricate the patient from the tub as desired. All such modifications and variations are within the scope of the appended claims when interpreted in accordance with the breadth to which they are fairly, legally and equitably entitled.

What is claimed:

1. A system for extricating a patient from a position from which extrication is desired, comprising:

a first hoist unit;

a second hoist unit;

a patient lifting pad; and a portable lift stand including a first cross member, a first telescoping support post, a second telescoping support post, a first telescoping strut and a second telescoping strut;

whereby said patient lifting pad is applied to said patient, said lift stand is erected adjacent said patient and said first and second hoist units are connected between said patient lifting pad and said lift stand and then used to lift said patient from said position; and wherein said position is within a vehicle and first and second struts have first ends that engage a roof of said vehicle so as to form a support structure over a door opening of said vehicle and said second ends are connected to said first cross member and said first and second support posts have feet for engaging the floor or ground.

2. The system of claim 1, wherein said first and second support posts are connected to said first cross member.

3. The system of claim 2, further including a second cross member, said first and second struts being connected to said second cross member adjacent said first ends.

4. The system of claim 3, further including a drive tool for said first and second hoist units.

5. The system of claim 4, wherein said drive tool is selected from a group of tools consisting of a manual crank, a power tool, an electric drill, a battery powered electric drill, a wrench, a pneumatic powered wrench, a screw driver and an electric screwdriver.

6. The system of claim 2 wherein said first and second support posts are pivotally secure together at their proximal ends.

7. The system of claim 2, further including a fastener to secure said vehicle roof mounting base to said vehicle.

8. The system of claim 7, wherein said fastener is a first ratchet line having a first ratchet for tensioning said first ratchet line, a first connector for securing to a hinge of said door on said vehicle and a second connector and said first and second struts include first and second feet at said first ends, said first ratchet line engaging said first and second feet.

9. The system of claim 8, wherein said fastener further includes a second ratchet line having a second ratchet for tensioning said second ratchet line, a third connector for securing to said portable lift stand and a fourth connector for securing to said vehicle with said second ratchet line extending over the roof of said vehicle substantially perpendicular to said first ratchet line.

10. The system of claim 1, wherein said first hoist unit includes:

a first hoist having a first housing including a first connection point, a first support connected between said first connection point and said first strut and a first line that may be extended or retracted by operation of said first hoist, said first line having a first distal end connected to said patient lifting pad; and wherein said second hoist unit includes a second hoist having a second housing including a second connection point, a second support connected between said second connection point and said cross member and a second line that may be extended or retracted by operation of said second hoist, said second line having a second distal end connected to said patient lifting pad.

11. A method of extricating a patient from a position from which extrication is desired, comprising:

applying a patient lifting pad to the patient;

positioning a portable lift stand having feet adjacent the patient;

erecting said portable lift stand;

engaging a portion of said portable lift stand with a roof of a vehicle above a door through which the patient will be lifted from said vehicle;

securing said portable lift stand by engaging the feet of said portable lift stand with a surface;

connecting first and second lift lines of first and second hoist units to said lifting pad; and operating said first and second hoist units to lift said patient from said position.

12. The method of claim 11 including connecting said first and second hoist units to a portion of an emergency vehicle having a height greater than the position of the patient.

13. The method of claim 11, including connecting said first and second hoist units between said lift stand and said patient lifting pad.

14. The method of claim 11, including connecting said first and second hoist units between said lift stand and said patient lifting pad.

15. The method of claim 14, including using a drive tool to operate said first and second hoist units.

16. A system for extricating a patient from a door opening in a vehicle having a door and a roof, comprising:

a first hoist unit;

a second hoist unit;

a patient lifting pad;

a portable lift stand including a first support post, a second support post, a first strut, a second strut and a first cross member, wherein the first and second support posts are connected to the first cross member and wherein the first and second struts having first and second ends, the first ends engage the roof of the vehicle so as to form a support structure over the door opening of the vehicle and the second ends are connected to the first cross member; and a first ratchet line for securing a vehicle roof mounting base to the vehicle, the first ratchet line having a first ratchet for tensioning said first ratchet line, (b) a first connector for securing to a hinge of the door on the vehicle and (c) a second connector and said first and second struts include first and second feet at said first ends, said first ratchet line engages said first and second feet, whereby the patient lifting pad is applied to the patient, the lift stand is erected adjacent the patient and the first and second hoist units are connected between the patient lifting pad and the lift stand and then used to lift the patient from the vehicle.

* * * * *